United States Patent [19]

Goss et al.

[11] 4,176,614

[45] Dec. 4, 1979

[54] CONTROL FORCE TANK AND METHOD FOR STABILIZING FLOATING VESSELS

[75] Inventors: Wilbur H. Goss, Santa Barbara; Gunnar B. Bergman, Montecito, both of Calif.

[73] Assignee: SeaTek Corporation, Goleta, Calif.

[21] Appl. No.: 891,543

[22] Filed: Mar. 30, 1978

Related U.S. Application Data

[63] Continuation of Ser. No. 734,111, Oct. 20, 1976, abandoned, which is a continuation-in-part of Ser. No. 731,006, Oct. 8, 1976, abandoned.

[51] Int. Cl.[2] ..... B63B 43/06

[52] U.S. Cl. ..... 114/125; 114/265; 405/200

[58] Field of Search ..... 61/92, 97; 114/122, 114/125, 126, 264, 265; 405/200

[56] References Cited

U.S. PATENT DOCUMENTS

| | | | |
|---|---|---|---|
| 2,889,795 | 6/1959 | Parks | 114/125 X |
| 3,207,110 | 9/1965 | LeBorde et al. | 114/125 X |
| 3,355,899 | 12/1967 | Koonce et al. | 114/265 X |
| 3,420,066 | 1/1969 | Bishop | 114/265 X |
| 3,537,412 | 11/1970 | Henderson | 114/122 |
| 3,808,998 | 5/1974 | Molotzak | 114/126 X |
| 3,886,886 | 6/1975 | Anders | 114/125 |
| 3,939,789 | 2/1976 | Anders | 114/125 X |

*Primary Examiner*—Stephen G. Kunin
*Attorney, Agent, or Firm*—F. D. LaRiviere

[57] ABSTRACT

Control forces for stabilizing semi-submersible platforms are provided outboard the platform columns, at a point approximately where the free surface of the water intersects the columns, without altering the internal arrangements or structure of the platform and employing equipment which develops pressures needed to impose control forces only. In a similar manner, control forces for stabilizing pitch and roll motions in ships and to effectively damp the oscillatory motion of the water level in a "moon pool" are provided.

16 Claims, 5 Drawing Figures

CONTROL FORCE TANK AND METHOD FOR STABILIZING FLOATING VESSELS

CROSS REFERENCE TO RELATED APPLICATION

This is a continuation of application Ser. No. 734,111, filed Oct. 20, 1976, which is a continuation-in-part of application Ser. No. 731,006, filed on Oct. 8, 1976, which is now abandoned.

BACKGROUND OF THE INVENTION

Prior ideas for generating control forces for stabilizing semi-submersible platforms in variable sea states involve tanks open at the bottom, located at the base of the columns which support the deck of the platform above the water surface. Such tanks may also be installed within the pontoons with open access at the bottom. Air pressure is then supplied to the enclosed space at the top of the tank in an amount necessary to balance the water pressure at the submerged open base, and varied in time about this average value to provide control forces on the platform necessary to suppress its motion in the water by using several such tanks in columns generally located at each corner of the platform. The prior art thus proposes to control roll and pitch motions in addition to the platform's response to heave. See, for example, U.S. Pat. Nos. 3,318,275 and 3,349,740.

It should be noted that in previous concepts such as described above, the effect of wave forces acting on the platform is unchanged by incorporation of such tanks in the columns or pontoons. Since the base areas of the columns or pontoons exposed to the static and dynamic sea forces would not be altered, the passive response characteristics of the platform would be unchanged whether or not the dynamic motion suppression system was in operation.

The inherent disadvantage of such prior art control systems is that the same equipment which provides the pressure necessary to develop the control forces also develops the pressure necessary to meet the static water pressure at the bottom of each of the columns. Moreover, the air pressure in the enclosed space at the top of the tanks is necessarily large to meet that static sea pressure as well as to provide additional increments of pressure for control forces when required by the dynamic motion suppression control system. The blowers necessary to provide the high ambient pressure and the large pressure variations due to waves are costly. In addition, to meet the peak flow and pressure required, large accumulators were necessary to store air at pressures of up to 60 PSIG. The volume of these accumulators was required to be on the order of 10,000 to 20,000 cubic feet. Such energy storage may be regarded as constituting a hazard to the over-all safety of the platform as well as adding to cost and space requirements. Finally, to install prior art control tanks, much internal modification and rearrangement of equipment of the platform is required.

Presently, ships or vessels having a vertical duct extending from the deck through the bottom of the hull and open to sea are used for offshore drilling and servicing operations. Such a duct is commonly referred to as a "moon pool", and constitutes a vertical water column. Derricks or cranes on the deck are used to lower equipment through such a duct to the sea floor. At other times, drilling operations are conducted through this duct.

The water level in the vertical duct rises and falls in response to periodically varying pressure at the base of the duct, the variation of pressure being induced by wave action. There is a frequency proportional to the effective length of the column at which the oscillating water column is naturally resonant, and at which small wave pressure changes produce greatly amplified oscillations of the water level in the duct. When equipment, such as a diving bell, is lowered through the duct on the way to emplacement on the sea floor, any oscillations in the level of the free surface of the column of the water can exert forces on the equipment being lowered. Such forces, for example, can momentarily raise the equipment, producing slack in the support cable, and then immediately thereafter cause the equipment to suddenly drop thus producing an impact stress on the cable, often causing the cable to break. Therefore, suppression of the oscillations of the "moon pool" water column is necessary to preclude the oscillatory forces caused thereby from endangering the crewman and integrity of the equipment and cable.

SUMMARY OF THE INVENTION

Control force modules constructed according to the principles of the present invention are tanks mounted outboard the columns of the platform at a point where the free surface of the water approximately intersects the column, such that the surface of the water approximately bisects the vertical dimension of the tank. Air is supplied to the chamber at the top half of the tank volume in such magnitudes and phases as are required to suppress the motion of the platform in response to a dynamic motion suppression control system. A suitable dynamic motion suppression control system is disclosed in U.S. patent application Ser. No. 649,997, entitled "Method and Apparatus for Stabilization of a Floating Structure", filed on Jan. 19, 1976 now abandoned, by Gunnar B. Bergman.

Since the tops of the tanks are exposed to atmospheric pressure at the water surface, valves may be installed which, when open, would allow water to rise and fall freely in the tanks in response to the passive motion of the platform. Thus, addition of the tanks does not change the passive response characteristic of the platform. When the valve at the top of the tanks is closed and air pressure inside the chamber is controlled by blowers to provide forces to the top of the tanks, the water level still rises and falls in the tanks, but such level changes are modified by the forces created by the air pressure in the chamber. The air flow demands upon the blower system which provides the air pressure to the tanks are only those required to develop control forces as determined by the dynamic suppression control system. Sea pressures at the base of these tanks are not transmitted to the platform.

Centrifugal or other low pressure, high volume blowers may be used to significantly reduce over-all cost, since blower pressures are only those needed to develop control forces. In addition, tanks can be added externally without altering the internal arrangements or structure of the platform and without changing the passive response characteristics of the platform to varying sea states. By opening valves at the top, the tanks have no effect upon the platform in the event the dynamic control system is deactivated. No accumulators are required since pressures are low enough for direct connection to the blowers, thus reducing cost and volume of additional equipment and eliminating hazard. Finally, the shape of the tank need not be cylindrical. For compatibility with existing structure, half-cylindrical or crescent-shaped tanks can be added to the side of existing columns.

Externally or outboard mounted tanks of the type described herein can be used not only for suppressing heave, but also for suppressing roll and pitch. Moreover, the motion suppression is not limited to semi-submersible platforms, but is applicable to any vessel having flotation means. Roll suppression for ships is, for example, an important application of such tanks because roll is usually the most offensive motion response of a ship, and because roll suppression of a ship requires relatively small forces.

For roll and pitch motion suppression of a ship, one or more cntrol force tanks are mounted on the port and starboard sides of the ship at approximately the water level. Air pressure to the tanks is then selectively increased and decreased to produce anti-roll and anti-pitch moments as determined by the dynamic motion suppression control system. The tanks may be independently controlled or coupled together via reversible air pumps.

In accordance also with the present invention, stabilization of the oscillating motion of water level in a "moon pool" is accomplished by installing a rigid or flexible cover over the top of the "moon pool". The cover is secured by quick-attach flanges at the top rim of the "moon pool" and may have provisions for the equipment support cable to pass through at the top or side, unless it is large enough to also house the deck equipment necessary for the particular operation being conducted.

The "moon pool" cover forms a chamber for containing a volume of air above the surface of the water which is substantially analogous to the air volume above the surface of the water in a force module tank. Air pressure to the chamber is selectively controlled to produce control forces required to materially increase the resonant frequency of oscillation and effectively damp the oscillatory motion of the water level in the "moon pool".

DESCRIPTION OF THE PREFERRED EMBODIMENT

Figure 1:
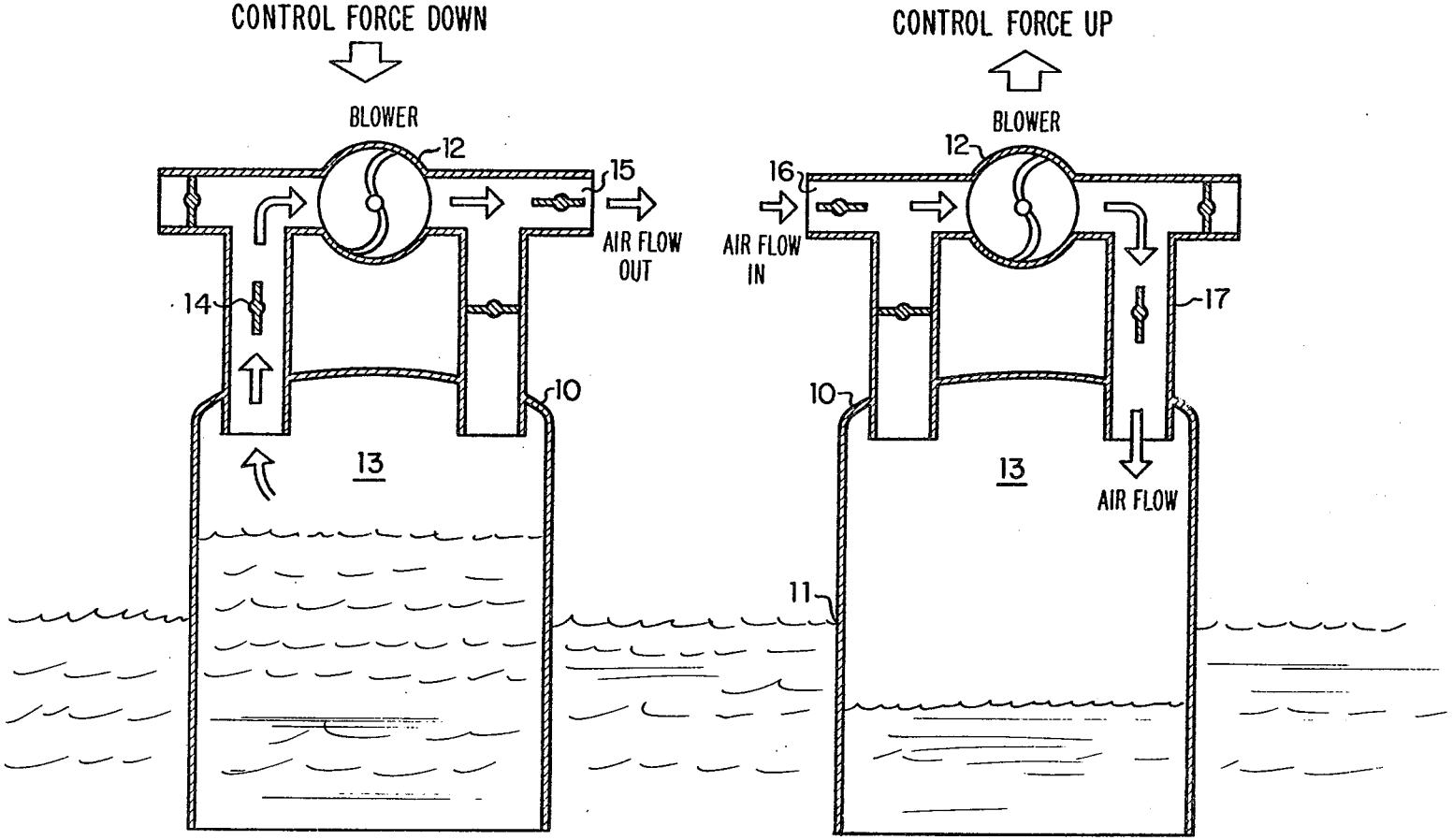
FIG. 1 is a cross-sectional diagram illustrating the principles of operation of a control force tank constructed according to the principles of the present invention.

Referring to FIG. 1, tank 10, having open access to the water at the bottom, is mounted at a location on a column of the platform (not shown) wherein the ambient surface of the water approximately bisects its side at 11. Blower 12 provides air pressure to chamber 13 of the tank in such magnitudes and phases as are needed to suppress the motion of the platform. As illustrated, to provide a downward control force, air is drawn out of chamber 13 through vent 14 and exhausted to the atmosphere at vent 15. Conversely, to provide upwardly directed force, air is drawn in from the atmosphere at vent 16 and blown into chamber 13 via valve 17. From time to time, the level of water in tank 10 for downwardly directed control forces is higher than the ambient level of the water, and, during development of upwardly directed control forces, the level of water in tank 10 is below that of the ambient water level.

Figures 2, 3:
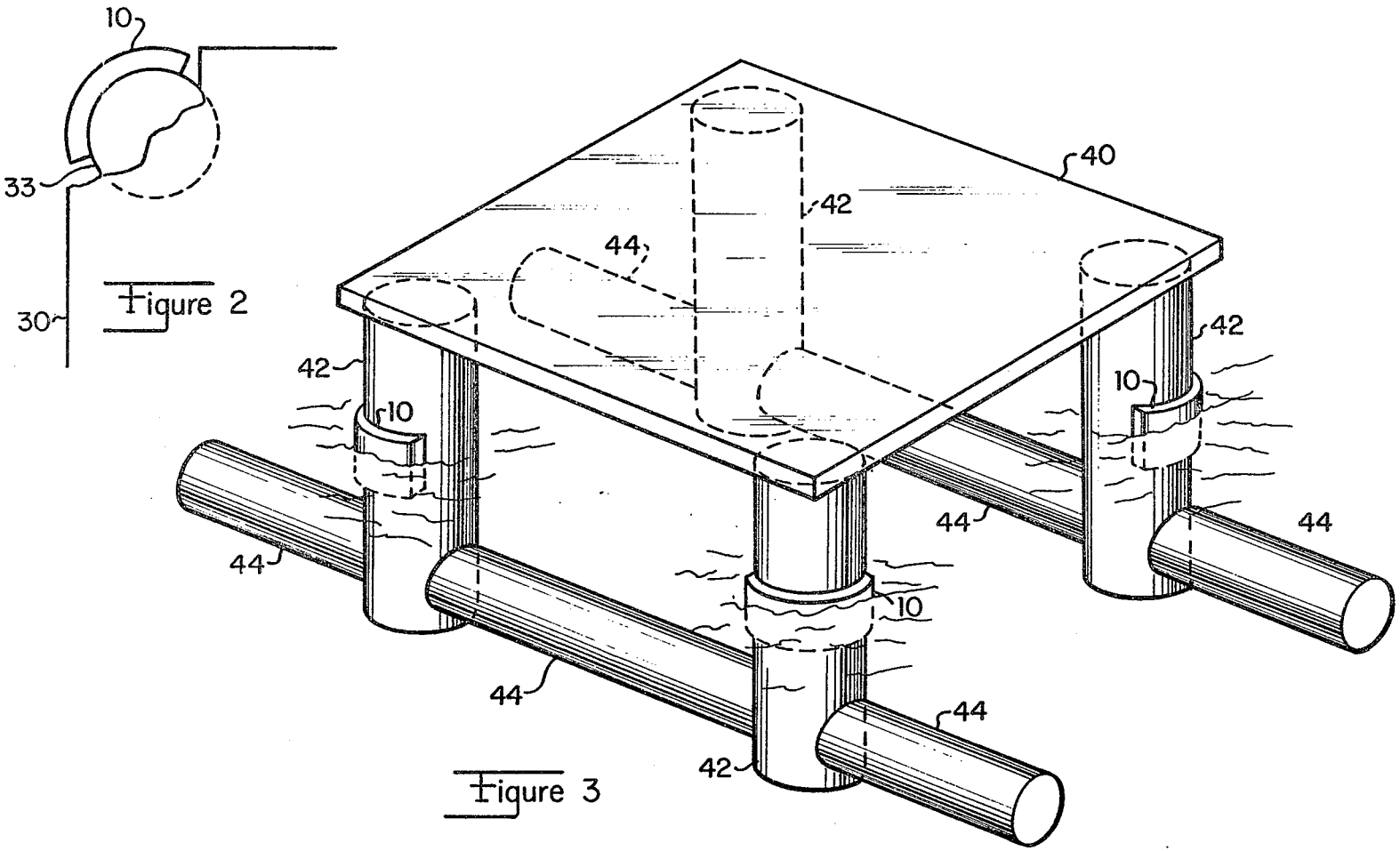
FIG. 2 is a top view of a control force tank shown through a cutaway of the platform deck constructed according to the preferred embodiment of the present invention.
FIG. 3 is a perspective view of a platform showing three of four of the control force tanks of FIG. 2 installed on the vertical columns located generally at the corners of the platform.

Referring now to FIG. 2, tank 10 is shown coupled to the outboard periphery of column 33. As indicated above, tank 10 can be of any shape which is compatible with the particular column design of the platform. Thus, tank 10 is crescent-shaped in this configuration and takes on the appearance of a fender at the water level of the column. Platform deck 30 has been cut away in the drawing to provide a clear top view of tank 10.

Referring now to FIG. 3, a semi-submersible platform having a deck 40, vertical columns 42 and pontoons 44 is shown schematically to illustrate the location of control force tanks 10 on the columns 42. As mentioned above, tanks 10 may take on any shape as shown in FIG. 2, so long as they develop sufficient control forces at each position to stabilize the platform. For typical platforms of approximately 40,000 square feet, tanks having a cross-sectional area of approximately 250 feet each, which in turn are pressurized to pressures up to 6 PSI will provide the required amount of control force. The size and shape of tanks 10, however, should provide for submersion of the bottoms thereof in varying surface conditions of the water.

Figure 4:
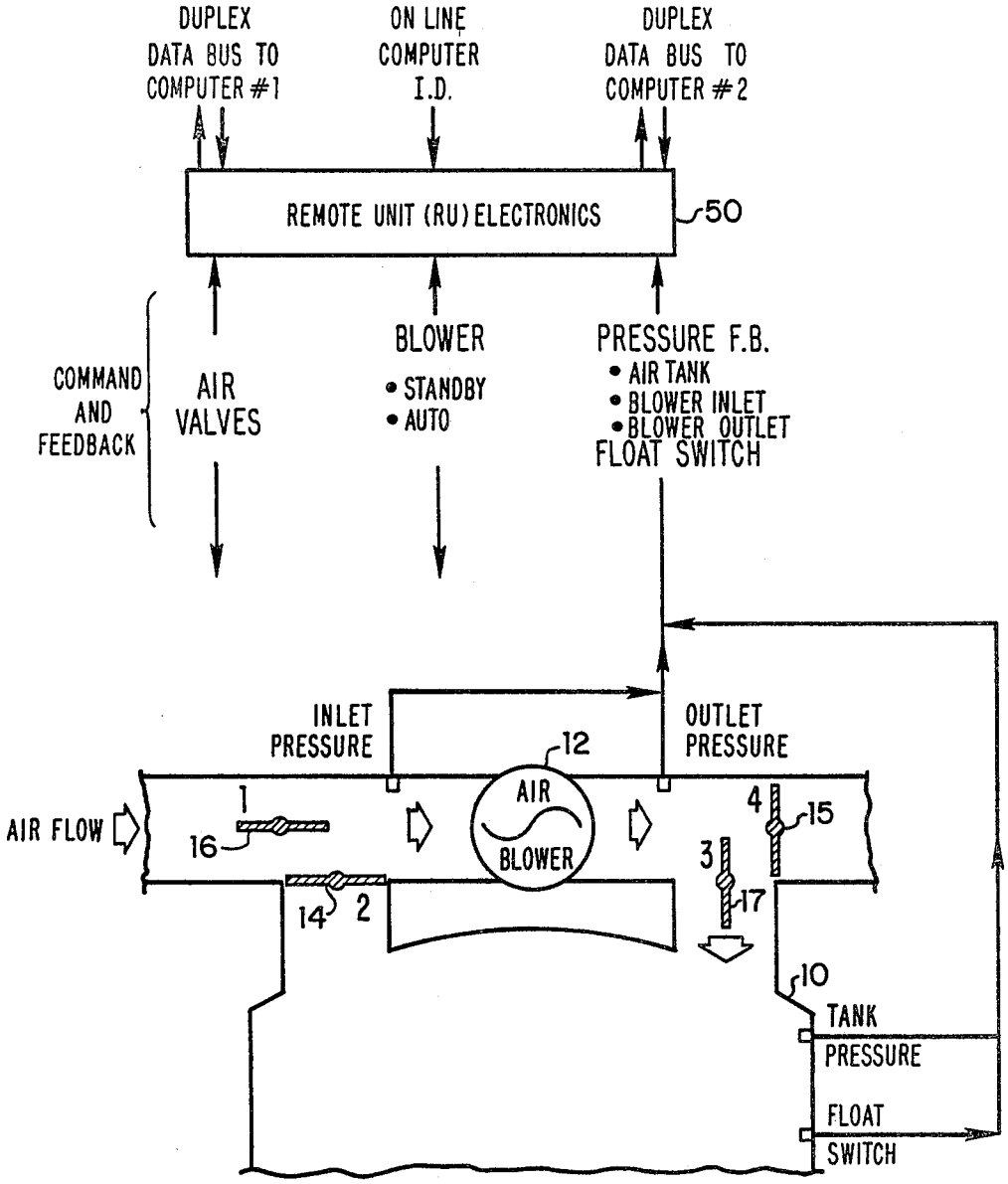
FIG. 4 is a function diagram of the control force tank of FIG. 1 in a dynamic motion suppression control system.

Referring now to FIG. 4, remote unit (RU) 50 provides command signals to the control valves and blowers which direct air pressure to develop control forces necessary to stabilize the platform. Additionally, it receives feedback signals which inform the on-line computer of the real-time status of the pressure in tanks 10 while performing its mathematical operations to dynamically stabilize the platform. A system similar to that disclosed in U.S. patent application Ser. No. 649,997 entitled "Method and Apparatus for Stabilization on a Floating Structure", filed Jan. 19, 1976 now abandoned, by Gunnar B. Bergman, which is hereby incorporated by reference as if fully set forth in this specification, is suitable for controlling the air supply to tanks 10.

As mentioned above, the motion suppression system of the present invention is applicable to any vessel having flotation means. One or more force module tanks as described herein, mounted externally on the starboard and port sides of a ship, approximately where the ambient surface of the water intersects the hull, may be used to suppress pitch and roll motions thereof. Air pressure to such tanks is selectively increased and decreased to produce anti-pitch and anti-roll moments as determined by the dynamic motion suppression control system. For example, at any particular instant in time, the air pressure in a starboard module may be increased while the pressure in a port module is decreased to produce the necessary control forces. It should be clear that one or more of the tanks may be symmetrically disposed along the water line of each side of the hull and the air thereto asymmetrically controlled, either separatlely or via reversible air pumps, or conversely, the tanks may also be asymmetrically located on the hull. In any event, control of air pressure to the tanks is a result of the resolution of anti-pitch and anti-roll moments necessary to stabilize the ship.

Figure 5:
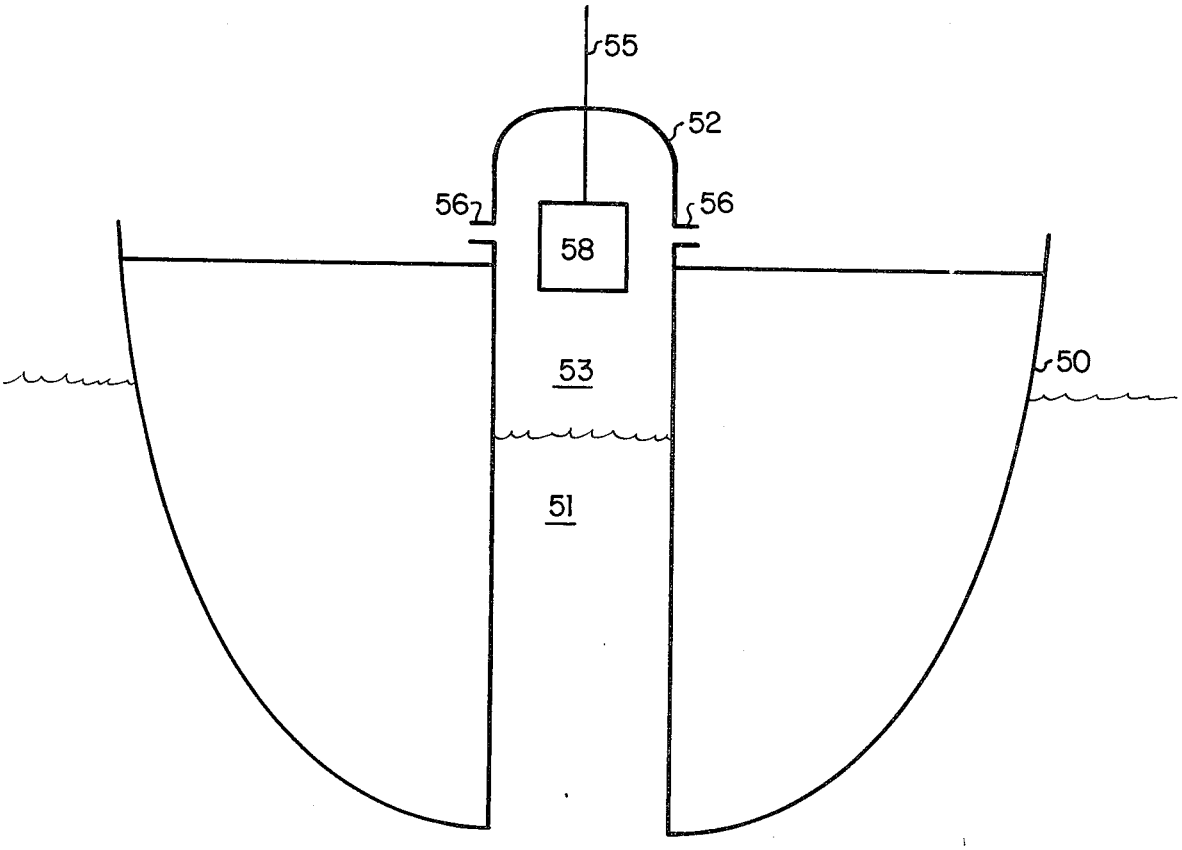
FIG. 5 is a cross-sectional view of the hull of a ship having a "moon pool" constructed according to the preferred embodiment of the present invention.

Referrng now to FIG. 5, ship hull 50 includes "moon pool" 51 having cover 52 through which cable 55 extends to support equipment load 58. Cover 52 is attached to the rim of pool 51 by quick-attach flanges 56. Cover 52 forms chamber 53 for enclosing an air volume above the water surface,which constitutes an air spring. The air spring acts in addition to gravitational forces to materially increase the resonant frequency of oscillation of the water level in pool 51. Since the power spectral density of ocean waves falls off very sharply with shorter periods (higher frequencies), there will be less driving energy and hence a reduced amplitude of oscillation. This effect is further enhanced by the greater attenuation of higher frequency waves with depth, according to the relationship $$p_d = CA\omega e(-2\pi df)/(v\omega)$$

in which C is a constant, $A\omega$ the amplitude of waves at frequency f, d is the depth, and $v\omega$ is the phase velocity of waves at frequency f. $P_d$ is the pressure at depth, d, which acts on the water column base in the "moon pool".

In addition to the benefits derived from increasing the resonant frequency of the water level in pool 51, the cover may be provided with one or more orifices of suitable or selectively controllable size, which, in addition to cable entry, would permit air to escape or enter chamber 53 as the water level in the column moves up and down. The pressure drop created by air flow through an orifice may be made proportioned to the square of the velocity of the escaping air, hence (neglecting compressibility effects) proportional to the square of the motion of the water level in the column. Such a force produces non-linear damping of the motion of the water, removing its kinetic energy and reducing its amplitude. It should be noted that the higher the frequency of oscillation, the more effective is this damping, adding further to the value of increasing the frequency by use of the air spring as heretofore described.

If further suppression of the water in the column is desired, an active system may be added by connecting an air blower so as to permit increasing or decreasing the pressure in chamber 53 thus providing control forces in the amount necessary to cancel the driving forces and to provide control forces to damp the motion, i.e., proportional to the velocity of the water in the column and opposite in direction. The control forces would be calculated by measuring the motion of the water in the column and feeding this signal, along with measurements of the pressures at the top and bottom of the column to a suitably programmed computer, such as that used in the dynamic motion suppression control system described herein. The control system then controls valves and blowers which, in turn, directs air flow into and out of chamber 53 to produce the required damping of the "moon pool" oscillations.

Cover 52 may be rigid; however, it may be desirable to employ a flexible cover using, for example, rubberized polyester fabric. Such a cover would require an air compressor to pressurize chamber 53 to maintain the pressure therein at all times above the ambient pressure. As with a rigid cover, damping forces can be generated by the use of pressure variations caused by the escape of air through orifices. The air compressor may be a positive displacement pump which will supply air at a rate to balance the time-average air loss through the damping orifices.

It also should be noted that one effect of pressurizing chamber 53 is to depress the water level in the "moon pool", shorten the effective length of the water, and increase the resonant frequency. In addition, the effect of the air spring is enhanced, since the higher pressure provides a stiffer air spring, and hence a higher resonant frequency.

Thus, either passive or active pressurizing systems or a combination thereof may be employed and either rigid or flexible cover may be utilized to damp the oscillation of the water level in pool 51. The passive system reduces the amplitude of oscillation of the water clumn as a result of a shift in resonance to higher frequencies and damping forces generated by suitably dimensioned (possibly controllable) orifices in cover 52. For an active system, varying air pressures can be supplied to chamber 53 in suitable phase and amplitude to substantially suppress the motion of the water in pool 51.

We claim:

1. A system for stabilizing a vessel having flotation means, said system comprising:

one or more tanks, having open access to the water, mounted to the outboard surfaces of the flotation means at a point where the ambient surface of the water approximately intersects the flotation means;

said tanks being selectively supplied with air in such magnitudes and phases as are required to develop control forces for producing control forces to stabilize the motion of the vessel in varying water conditions;

said control forces being developed solely by the selective supply of air to said tanks.

2. A system for stabilizing a floating vessel as in claim 1 wherein the tanks include controllable vents at a location above the ambient surface of the water to allow the water level in the tank to rise and fall freely when open, and to form a pressurization chamber above the surface of the water in the tanks when closed.

3. A system for stabilizing a floating vessel as in claim 1 wherein access of the tanks to the water is adequate to allow for varying surface conditions of the water.

4. A system for stabilizing a floating vessel as in claim 1 wherein the tanks have a shape conforming to the contours of the hull at the point where the hull approximately intersects the ambient surface of the water.

5. A system for stabilizing a vessel as in claim 1 wherein the water flow into and out of the tanks is controlled solely by the air supplied to the tanks.

6. A system for stabilizing a vessel as in claim 5 wherein the water flow into and out of the tanks is controlled solely by the air supplied to the portion of the tank above the surface of the water therein.

7. A system for stabilizing a vessel as in claim 1 wherein the flotation means includes at least one of the vertical columns of semi-submersible platform.

8. A system for stabilizing a vessel as in claim 1 wherein the floatation means is the hull of a ship.

9. A system for stabilizing a vessel having flotation means as in claim 1 wherein said system is effective for stabilizing pitch and roll motions of the vessel.

10. A system for stabilizing a vessel having flotation means as in claim 1 wherein said system is effective for stabilizing heave motion of the vessel.

11. A method of applying control forces for stabilizing a vessel having a flotation member, said method comprising the step of applying selectively variable control forces to the outboard surface of the flotation member at a point where said flotation member approximately intersects the ambient surface of the water independent of the movement of the vessel through the water.

12. The method of applying cntrol forces for stabilizing a vessel as in claim 11 further including the steps of:

mounting one or more tanks, having open access to the water to outboard surface of the port and starboard sides of the vessel at a point where the ambient surface of the water approximately intersects the floatation means so that the surface of the water approximately bisects the vertical dimension of the tanks; and selectively supplying air to the tanks in such magnitudes and phases as are required to develop control forces for stabilizing the motion of the vessel in varying water conditions;

said control forces being developed solely by the selective supply of air to said tanks.

13. A method for stabilizing a vessel as in claim 11 wherein the flotation member includes at least one of the vertical columns of a semi-submersible platform.

14. A method for stabilizing a vessel as in claim 11 wherein the flotation member is the hull of a ship.

15. A method of applying control forces for stabilizing a vessel having a flotation member as in claim 11 wherein said system is effective for stabilizing pitch and roll motions of the vessel.

16. A method of applying control forces for stabilizing a vessel having a flotation member as in claim 11 wherein said system is effective for stabilizing heave motion of the vessel.

* * * * *